United States Patent [19]

Alexander

[11] 4,118,056

[45] Oct. 3, 1978

[54] MORTISE LOCK

[75] Inventor: Gordon A. Alexander, Newington, Conn.

[73] Assignee: Emhart Industries, Inc., Farmington, Conn.

[21] Appl. No.: 784,060

[22] Filed: Apr. 4, 1977

[51] Int. Cl.[2] ..... E05C 1/16

[52] U.S. Cl. ..... 292/169.17; 70/151 A; 292/169

[58] Field of Search ..... 292/169.16, 169.17, 292/169.14, 169.15, 169, 169.13; 70/151 R, 151 A, 150

[56] References Cited

U.S. PATENT DOCUMENTS

| | | | |
|---|---|---|---|
| 1,604,946 | 10/1926 | Shaw | 70/151 R |
| 1,723,803 | 8/1929 | Moore | 292/169.16 X |
| 2,580,237 | 12/1951 | McConnell | 292/169.16 |
| 3,211,486 | 10/1965 | Crandell | 292/169.16 X |
| 3,420,561 | 1/1969 | Russell et al. | 70/150 X |

FOREIGN PATENT DOCUMENTS

| | | | |
|---|---|---|---|
| 2,458,131 | 6/1976 | Fed. Rep. of Germany | 292/169.17 |
| 1,181,420 | 2/1970 | United Kingdom | 292/169 |

*Primary Examiner*—Roy D. Frazier
*Assistant Examiner*—William E. Lyddane
*Attorney, Agent, or Firm*—McCormick, Paulding & Huber

[57] ABSTRACT

A mortise lock having an entrance and apartment function and including a spring projected latch bolt, a latch bolt retracting mechanism having an L-shaped retractor rectilinearly moveable in response to rotation of either an inner or an outer rollback hub, a snap action toggle operated stopworks for locking the outer rollback hub, and a deadlocking mechanism including a deadlocking lever controlled by an auxiliary bolt and moveable into and out of blocking relation with the latch bolt in its projected position. An abutment on the deadlocking lever cooperates with an abutment on the lock case when the deadlocking lever is in its deadlocking position to resist transmission of force applied to the latch bolt in a retracting direction.

15 Claims, 8 Drawing Figures

FIG. 1
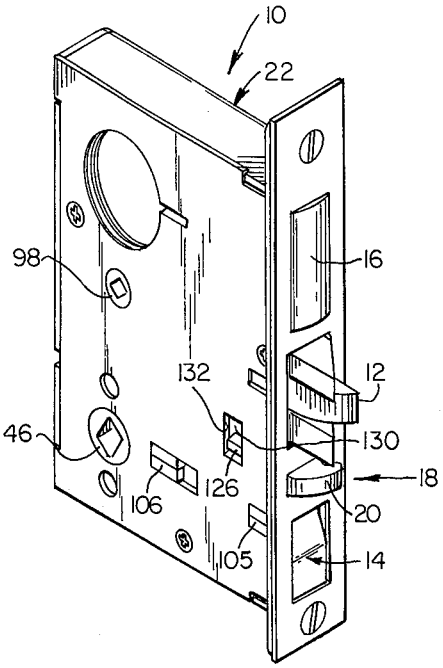
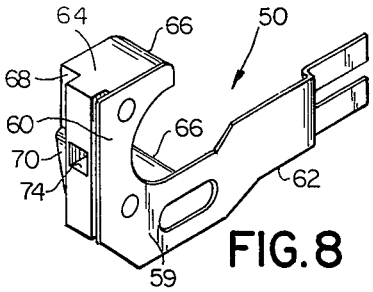
FIG. 8
FIG. 2
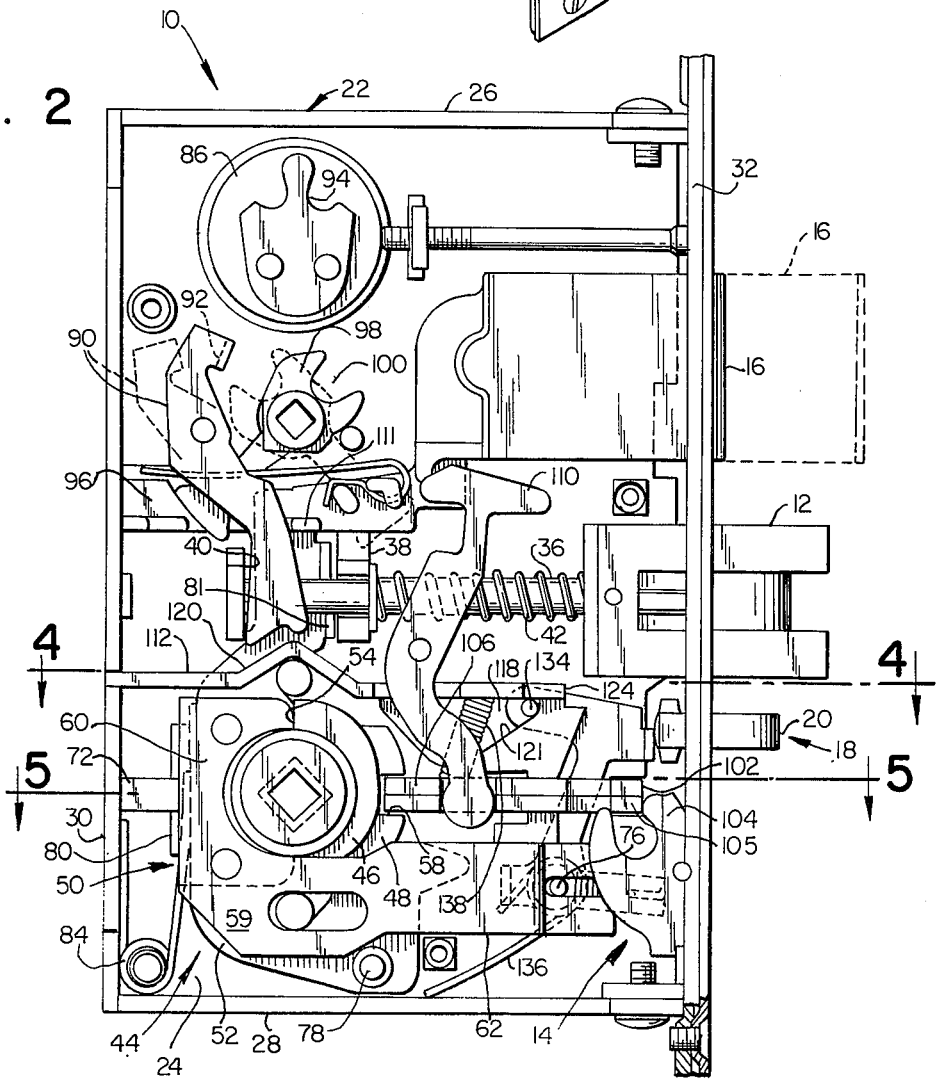

MORTISE LOCK

BACKGROUND OF THE INVENTION

This invention relates in general to mortise locks and deals more particularly with an improved mortise lock having an entrance or apartment function.

A mortise lock of the aforedescribed type generally includes a latch bolt which may be operated by a knob from either side of a door, a stopworks for locking the outside knob, and a dead bolt operated by a key from the outside and which may be arranged for operation by either a turnpiece or a key from the inside. In conformance with certain building specifications and codes the dead bolt must have a one inch throw. Mechanism may also be included for deadlocking the latch bolt in projected position when the outer knob is locked by the stopworks and for locking the outer knob and deadlocking the latch bolt whenever the deadbolt is projected. Mechanism for enabling the aforedescribed general functions must be compact, durable, and highly reliable to attain the degree of security required. Further, such mechanism must be versatile to enable variation of function by the addition, elimination, or interchange of parts so that the basic mortise lock structure may be readily converted from one function to another. The general aim of the present invention is to provide an improved mortise lock of the aforedescribed general type which satisfies the requirements hereinbefore set forth.

SUMMARY OF THE INVENTION

In accordance with the present invention a mortise lock is provided which has inner and outer rollback hubs journalled for independent coaxial rotation within a case and a generally L-shaped retractor supported in the case and having one leg disposed rearwardly of the hubs for engagement therewith and another leg extending forwardly beyond the hubs. A pair of retractor guide members mounted in fixed position on the case each respectively engage an associated one of the legs of the retractor to support it for reciprocal rectilinear movement between first and second positions respectively corresponding to projecting end retracted positions of the latch bolt. The lock may also include a latch bolt deadlocking mechanism which has an elongated deadlocking lever formed from flat metal of substantially uniform thickness. The deadlocking lever is pivotally supported at the rear of the case and has a blocking surface at its forward end moveable into blocking relation rearwardly of the latch bolt when the latch bolt is in its projected position and the deadlocking lever is in its deadlocking position. The dedlocking lever further includes a ramp surface intermediate its pivot and its blocking surface which cooperates with other mechanism to move the deadlocking lever out of deadlocking relation with the latch bolt in response to the initial movement of the latch bolt toward its retracted position. A means is provided for preventing transmission of force applied to the latch bolt in a retracting direction to the ramp surface when said deadlocking lever is in its deadlocking position.

BRIEF DESCRIPTION OF THE DRAWINGS

FIG. 1 is a perspective view of a mortise lock embodying the present invention.

FIG. 2 is a somewhat enlarged fragmentary side elevational view of the mortise lock of FIG. 1 shown with the cap removed from the lock case to expose mechanism therein.

FIG. 8 is a perspective view of the latch bolt retractor.

DETAILED DESCRIPTION OF PREFERRED EMBODIMENT

Figure 3:
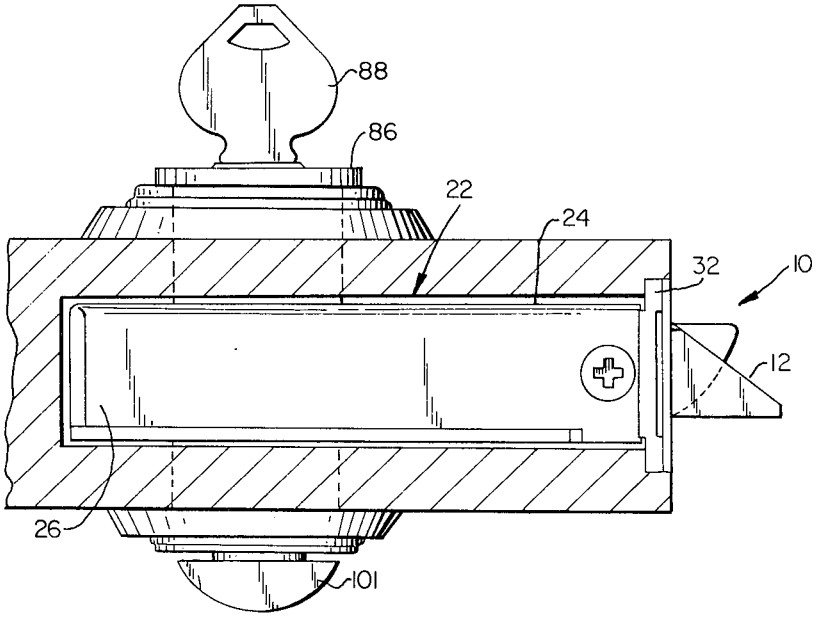
FIG. 3 is a somewhat enlarged plan view of the mortise lock of FIG. 1 shown mounted on a door.

Turning now to the drawings, a mortise lock which has a typical arrangement of parts embodying the present invention is indicated generally by the reference numeral 10. The illustrated lock is adapted for mounting in a mortise in the outer edge of a door, has an entrance and apartment function, and includes an anti-friction latch bolt 12 which is spring urged to a normally projected position and may be retracted by rotation of either an inside or an outside operating knob or the like (not shown). The latch bolt 12 may be retracted at all times by rotation of the inner operating knob in either a clockwise or counterclockwise direction, however, a stopworks indicated generally at 14 is provided for locking or disabling the outer operating knob. The lock mechanism further includes a deadbolt 16 which may be operated from the outer side of the door by a conventional key operated lock cylinder and which may be operated from the inner side by a thumb turn or another lock cylinder, as desired. A deadlocking mechanism, indicated generally at 18, controlled by an auxiliary bolt 20 is operable to deadlock the latch bolt 12 in a projected position when the outer knob is locked by the stopworks.

Considering the illustrated lock 10 in further detail, it has a rectangular wrought metal case indicated generally at 22 and adapted to be received within a mortise in the free edge of a door. A formed body portion of the case includes a side wall 24 and integral top, bottom and rear walls indicated at 26, 28 and 30, respectively. A front 32 secured to the top wall 26 and the bottom wall 28 is angularly adjustable relative to the body of the case for mounting flush with the bevel edge of a door of either hand and carries a conventional scalp or face plate. A cap or cover 34 which forms a closure for the case body defines the other side wall of the case 22. The lock 10 is reversible, therefore, either side wall of the case may comprise the outer side wall of the lock. However, when the lock 10 is assembled as illustrated, the side wall 24 comprises the outer side wall and will be hereinafter so described.

The latch bolt 12 is of a reversible antifriction type and is supported in an aperture in the front 32. It has a tailpiece 36 which projects rearwardly through a guide slot formed in a boss 38 mounted in fixed position on the outer side wall 24. A tail plate mounted at the rear end of the tailpiece has a forwardly facing abutment surface 40 thereon. The latch bolt 12 is normally urged toward its projected position shown in full lines in FIGS. 2 and 4 by a compression spring 42 which surrounds the tailpiece 36 and acts between the boss 38 and the rear of the latch bolt 12.

Figure 5:
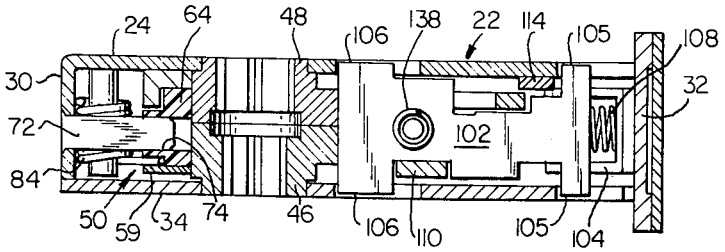
FIG. 5 is a sectional view taken along the line 5—5 of FIG. 2.
Figure 6:
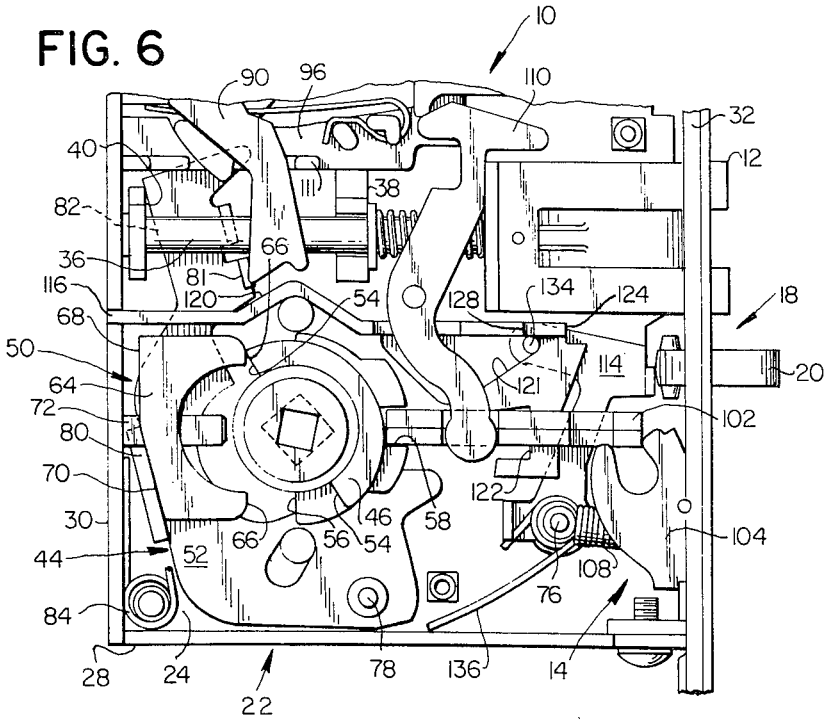
FIG. 6 is similar to FIG. 1, but shows the latch bolt in a retracted position.

A retractor mechanism, indicated generally at 44, for retracting the latch bolt 12 in response to operation of either an inner or an outer operating knob generally comprises inner and outer rollback hubs indicated at 46 and 48, respectively, supported for independent coaxial rotation within the case 22 and centrally apertured for conventional connection with inner and outer knob spindles. The retractor mechanism also includes a retractor element indicated generally at 50, arranged for movement in response to rotation of either of the rollback hubs, and a hub lever 52 for retracting the latch bolt in response to movement of the retractor element 50, as will be hereinafter further discussed. The inner rollback hub has a generally cylindrical reduced bearing portion journalled in an associated bearing aperture in the inner side wall 34, as best shown in FIGS. 1 and 5. The inner hub further includes a pair of diametrically opposed radially disposed rollback surfaces 54, 54 which face in the direction of the rear wall 30 when the latch bolt is in its projected position, as best shown in FIG. 6. The outer rollback hub 48 is similarly constructed and has a reduced cylindrical bearing portion journalled in the outer side wall 24, as shown in FIG. 5. The outer rollback hub also has a pair of diametrically opposed radially disposed and rearwardly facing rollback surfaces 56, 56, best shown in FIG. 7, however, the outer rollback 48 has an enlarged body portion which defines a notch 58 angularly offset approximately 90 degrees from the rollback surfaces 56, 56 and which opens toward the front of the lock when the outer hub 48 is in its position of FIG. 2. The retractor element 50 comprises a generally L-shaped member 59 which has one leg 60 disposed rearwardly of the hubs 46 and 48 and another leg 62 which extends beyond the hubs and toward the front of the case. A nonmetalic retractor shoe 64, preferably made from low friction plastic material, is attached to and comprises a part of the leg 60. The leg 60 has a forwardly opening semicylindrical recess which generally complements associated portions of the hubs 46 and 48. The retractor shoe 64 has generally radially disposed and forwardly facing arcuate bearing surfaces 66, 66 at diametrically opposite sides of the latter recess for engagement with the rollback surfaces 54, 54 and 56, 56. The retractor shoe 64 also has rearwardly facing upper and lower bearing surfaces 68 and 70 respectively, as shown in FIG. 6, the lower bearing surface 70 being slightly downwardly and forwardly inclined. Support for the retractor element 50 is provided by a retractor guide member or guide pin 72 mounted on the rear wall 30 and projecting in a forward direction toward the hubs 46 and 48. The guide pin 72 has a non-circular cross section and is slidably received in a complementary bore 74 formed in the retractor shoe 64 and shown in FIG. 6. The leg 62 is slotted at its forward end to receive another retractor guide member or guide pin 76 which is supported in fixed position on the side wall 24 and which projects in a lateral or transverse direction therefrom. The hub lever 52 comprises a generally L-shaped lever formed from flat metal and supported within the case 22 generally adjacent the side wall 24. It is pivotally supported at its forward end below and forward of the hubs 46 and 48 by a pivot pin 78 supported on the case. One leg of the L-shaped lever 52 extends upwardly to the rear of the hubs 46, 48 and has a laterally projecting tab 80 for engaging the bearing surfaces 68 and 70 on the retractor shoe. Another tab 81 extends laterally outwardly from the hub lever intermediate its ends. At its upper end the lever 52 has a rearwardly facing bearing surface 82 for engaging the abutment surface 40 on the latch bolt tail plate. A coil spring 84 acts between the rear wall 30 and the retractor shoe 64 to normally urge the retractor element toward engagement with the rollback hubs. The spring projected bolt 12 acts upon the upper end of the hub lever 52 to bias the tab 80 into operative engagement with the retractor shoe 64.

The latch bolt operating mechanism of the illustrated lock 10 also includes a conventional key operated outer lock cylinder 86, threaded into the outer side wall 24 (FIG. 3), which may be operated from the outer side of a door at all times by a key 88 to retract the latch bolt 12. The latter mechanism further includes a cylinder latch lever 90 supported on the outer side wall of the case 22 to pivot about a transverse axis intermediate its ends. The upper end of the lever 90 carries a tab 92 which is disposed in the path of an eccentric cam 94 mounted on the inner end of a key plug (not shown) which comprises a part of the lock cylinder 86. Rotation of the key (FIG. 3) in a clockwise direction causes corresponding counterclockwise rotation of the cam, as it appears in FIG. 2. The cam engages the upper end of the cylinder latch lever to pivot it in a clockwise direction whereby the lower end of the lever engages the abutment 40 to move the tailpiece rearwardly to retract the latch bolt 12.

The deadbolt 16 is supported in an opening in the front wall 32 and has an offset tailpiece 96 which is slidable supported on the boss 38. It is moved between projected end and retracted positions by a turn knob hub 98 which is journalled on and extends between the case side walls 24 and 34, and which has an extending end portion engaged within a slot in the deadbolt tailpiece 96. The turn knob hub 98 has a recess 100 for receiving an eccentric cam 94. The deadbolt 16 may be projected or retracted from the inner side of a door at all times by a thumbturn cylinder, such as indicated at 101 in FIG. 3 which has an eccentric cam similar to the cam 94. Alternatively, a turnpiece (not shown) may be directly connected to the turn knob hub 98 to operate it from the inner side. However, if additional security is desired, an inner key operated lock cylinder may be provided for operating the turn knob hub 98 to project and retract the deadbolt 16.

Figure 7:
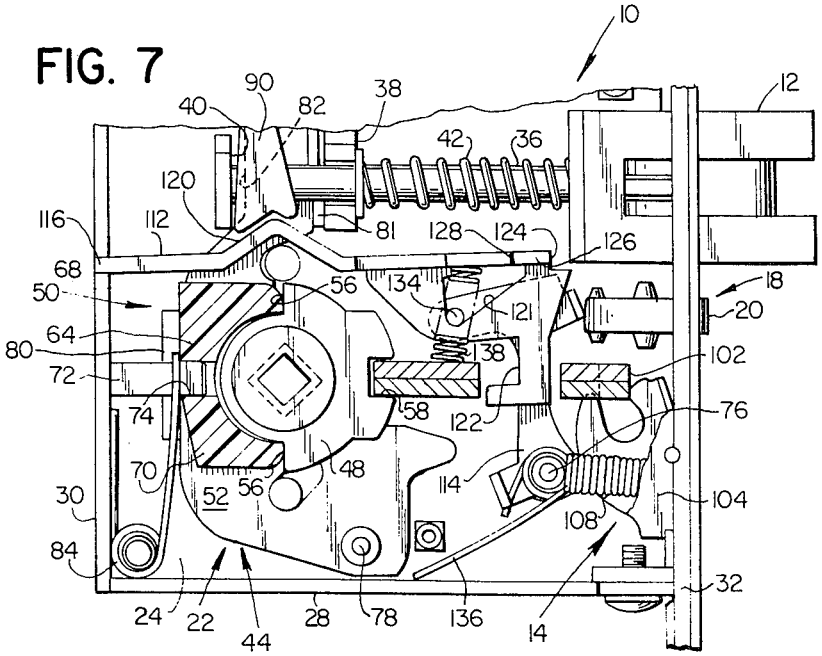
FIG. 7 is a fragmentary sectional view taken along the line 7—7 of FIG. 5 and shows the auxiliary bolt in a retracted position and the deadlocking mechanism in a deadlocking position.

Considering now the stopworks 14 in further detail, this mechanism includes a stop 102 and a snap action toggle button 104 for moving the stop into and out of locking relation with the outer hub 48. The stop 102 generally comprises an elongated stop plate which has transversely outwardly extending tabs 105, 105 and 106, 106 in its opposite ends respectively received within associated slots in the side walls 24 and 34, as best shown in FIG. 5. The latter slots support the stop plate for movement generally toward and away from the rollback hubs 46 and 48 between locked and unlocked positions relative to the outer rollback hub 48. When the stopworks 14 is in its locked position the rear end portion of the stop plate 102 is disposed within the notch 58 in the outer rollback hub as shown in FIGS. 6 and 7. The toggle button 104 for moving the stop plate comprises a formed metal button supported to pivot about a transverse axis within an aperture in the front 32. The toggle button straddles the front end portion of the stop plate 102 and is recessed to receive and engage the tabs 105, 105 substantially as shown. A compression spring 108 acts between the guide pin 76 and a pivoted spring retainer carried by the toggle button 104 to exert an overcenter biasing action on the toggle button when it is pivoted to either of its two positions corresponding to the locked and unlocked positions of the stopworks. Thus, the toggle button exerts snap action on the stop plate 102 when it is moved toward either its locking or unlocking position relative to the rollback hub 48. The stopworks 14 is also arranged to operate in response to movement of the deadbolt 16 to its projected position and for this purpose a stop lever 110 is provided. The lever 110 is supported intermediate its ends to pivot about an axis which extends transversely of the case. The lower end of the lever 110 is disposed within a notch in the stop plate 102, whereas the upper end of the lever is disposed in the path of a transverse projection 111 on the deadbolt tail. Thus, when the deadbolt 16 is moved from its retracted or full line position to its projected or broken line position of FIG. 2 the projection 111 engages the upper end portion of the lever 110 to pivot the lever 110 in a clockwise direction to the position in which it appears in FIG. 2. When the lever 110 is in the latter position the stopworks 14 is locked, so that the outer knob is secured against rotation.

Figure 4:
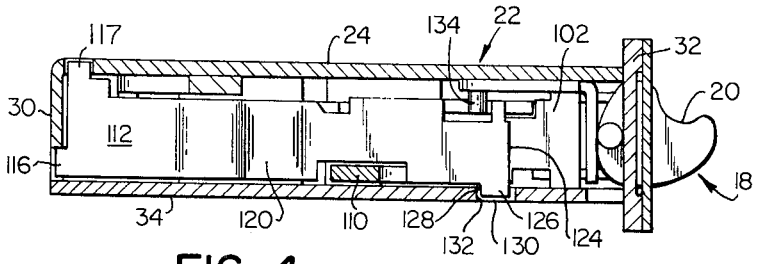
FIG. 4 is a sectional view taken generally along the line 4—4 of FIG. 2.

In addition to the auxiliary bolt 20, the deadlocking mechanism 18 includes a deadlocking lever 112 and an auxiliary latch lever 114. The deadlocking lever is formed from flat metal and has a profile of substantially uniform thickness throughout its length, as viewed in FIGS. 2, 6 and 7. At its rear end the lever 112 has a rearwardly projecting tab 116 which is received within a slot within a rearwall 30 and a laterally projecting tab 117 which is received within another slot formed in the side wall 24. The latter tabs cooperate with the associated slots in the case to support the deadlocking lever 112 for limited pivotal movement within the case 22. The lever 112 has a ramp portion 120 formed intermediate its ends and which has a generally chevron or inverted V-shape, as viewed in FIGS. 2, 6 and 7. A depending side portion of the lever 112 forward of the ramp portion has an opening 118 therethrough which defines a generally forwardly and upwardly inclined cam surface 121. The lower part of the lever side portion is formed with a rearwardly opening notch 122, best shown in FIG. 7. At its forward end the lever 112 has a forwardly facing blocking surface 124. A tab 126 extends laterally outwardly at the forward end of the lever 112 and defines a rearwardly facing abutment surface 128. The tab 126 is received within a vertically disposed slot 130 formed within the inner side wall 34. The latter slot defines a forwardly facing abutment surface 132, as best shown in FIGS. 1 and 4. The auxiliary latch lever 114 as viewed in FIGS. 2, 6 and 7 comprises an inverted generally L-shaped lever which is pivotally supported at its lower end on the guide pin 76. A camming pin 134 is mounted on a free end of its upper leg, the latter pin being received within the opening 121. The auxiliary latch lever 114 has a laterally projecting tab exposed adjacent the inner end of the auxiliary bolt 20 which is supported to pivot within a opening in the front 32. A coil spring 136 surrounds the guide pin 76 and acts between the auxiliary latch lever and the case to bias the auxiliary latch lever 114 in a clockwise direction and toward the auxiliary bolt 20, as shown in FIGS. 2, 6 and 7. A compression spring 138 acts between the deadlocking lever 112 and the stop plate 102 to bias the deadlocking lever upwardly and in a counterclockwise direction toward a locking position, shown in FIG. 7, wherein the abutment surface 124 is disposed rearwardly of and in blocking relation with the latch bolt 12.

Referring now particularly to FIG. 2, the lock 10 is shown with the stopworks 14 in locked condition. The deadbolt 16 is retracted, the latch bolt 12 is projected, and other parts of the mechanism are shown in positions corresponding to an open door condition. Since the auxiliary bolt 20 is projected the auxiliary latch lever 114 retains the deadlocking lever 112 in an inactive position out of the path of the latch bolt 12. More specifically, the camming pin 134 carried by the auxiliary latching lever 114 engages the upper end portion of cam surface 121 on the deadlocking lever 112 to hold the latter lever in its inactive position as it appears in FIG. 2. As the door is closed the latch bolt 12 is retracted by initial engagement with the strike and is spring projected into the strike when the door attains its fully closed position. Upon engagement with the strike the auxiliary bolt 20 retracts causing the auxiliary latch lever 114 to pivot in a counterclockwise direction from its position of FIG. 2 to its position of FIG. 7. The travel of the camming pin 134 relative to the cam surface 121 permits the deadlocking lever 112 to pivot in a counterclockwise direction from its position of FIG. 2 to its deadlocking position of FIG. 7, under the biasing force of the compression spring 138.

When the deadlocking lever 112 is in its deadlocking position the abutment surface 124 is disposed immediately rearwardly of and in blocking relation to the latch bolt 112. If entry is attempted by applying prying force to the latch bolt in the direction of retraction this force will be transmitted to the abutment surface 124, however, the rearwardly facing abutment surface 128 cooperates with the forwardly facing abutment surface 132 on the side wall 34 to prevent transmission of this force to the ramp portion 120.

The deadbolt 16 is moved between its projected and retracted positions by turn knob hub 98 operated from the outer side by the lock cylinder 86 or from the inner side by the illustrated thumb turn cylinder 101. In the illustrated embodiment the stopworks 14 locks automatically whenever the latch bolt 16 is projected. If the stopworks 14 is unlocked when the deadbolt 16 is thrown to its projected position, the projection 111 on the deadbolt tail engages the upper end of the stop lever 110 to move the lever in a clockwise direction to its locked position of FIG. 2 as the deadbolt 16 is thrown.

The latch bolt can be retracted at all times from the inner side by operating the inner knob to rotate the inner rollback hub 46 in either direction. Rotation of the inner rollback hub causes one of the rollback surfaces 54 to engage an associated bearing surface 66 on the retractor shoe 64 which causes the retractor 50 to move rearwardly to a latch bolt retracting position. The bearing surfaces 68 and 70 successively engage the tab 80 to urge the hub lever 52 in a counterclockwise direction from its position of FIG. 7 toward its position of FIG. 6. The bearing surface on the upper end of bearing surface 82 acts upon the abutment surface 40 on the latch bolt tailplate to move the latch bolt 12 toward its retracted position. During the initial counterclockwise movement of the hub lever 52 the tab 81 engages the ramp portion to move the deadlocking lever 112 from its deadlocking position of FIG. 7 toward its inactive position of FIG. 6 out of the path of the latch bolt. In FIG. 6 the parts of the lock are shown after the inner rollback hub 46 has rotated in a counterclockwise direction to retract the latch bolt. As the auxiliary bolt moves out of engagement with the strike and from its position of FIG. 7 toward its position of FIG. 5, the auxiliary latch lever 114 pivots in a clockwise direction under the biasing force of the spring 136 whereby to move the deadlocking lever to and retain it in its inactive position, as it appears in FIG. 6.

When the stopworks 114 is in its locked position, as shown, the lock 10 may be unlocked from the outer side by the key 88. When the key is rotated in a clockwise direction the eccentric cam 94 rotates in a counterclockwise direction from its position of FIG. 2. The cam 94 first engages the turn knob hub 98 within the recess 100 and rotates it in a clockwise direction from its borken line to its full line position of FIG. 2. The lower end portion of the turn knob hub which is disposed within an associated notch in the deadbolt tail engages the tail to retract the deadbolt and allow the cylinder lock lever 90 to move from its broken to its full line position of FIG. 2. Thereafter, continued rotation of the key 88 in a clockwise direction causes the cam 94 to engage the cylinder lock lever 90 and pivot it in a clockwise direction from its full line position of FIG. 2. During the initial pivotal movement of the cylinder latch lever 90 the lower end of the lever engages the ramp portion 120 to move the deadlocking lever toward its inactive position. Further counterclockwise movement of the cylinder lock lever 90 under the urgence of the cam 94 causes retraction of the latch bolt 12 in a conventional manner. As the latch bolt moves out of engagement with the strike the auxiliary bolt 20 moves toward its projected position and assumes control of the deadlocking lever 112 to maintain it in its inactive position, as aforediscussed.

The stopworks 14 is unlocked by depressing the lower end portion of the toggle button 104. As the lower end portion of the button is depressed the position of the spring 108 changes relative to the button due to the pivotal connection between the button and its spring retainer. When the spring 108 travels over the pivotal center of the toggle button a snap action occurs which causes the stopworks to snap to its unlocked position wherein the stop plate 102 is out of engagement with the notch 58. In the illustrated embodiment, in order to operate the stopworks 14 the door must be open to expose the toggle button 104. The deadlocking lever 112 will be in its inactive position, beng held in the latter position by the controlling action of the projected auxiliary bolt 20. When the toggle operated stopworks is moved to its unlocked position the stop plate 102 moves into the notch 122 to latch the deadlocking lever in its inactive position. Thus, when the deadlocking lever will be positively retained in its inactive position when the stopworks is in its unlocked condition. Thereafter, the latch bolt may be retracted by rotating either the inner or the outer operating knob in either direction.

In the illustrated embodiment the stopworks 14 may be locked to lock the outer knob either by manipulating the toggle button 104 or by moving the deadbolt 16 to its projected position. However, in the illustrated lock 10 the stopworks may be released only by operation of the toggle button 104.

I claim:

1. In a mortise lock having a case including a front and inner and outer side walls, a spring projected latch bolt movable through the front between projected and retracted positions, a latch bolt retractor mechanism including inner and outer hubs journalled for independent rotation within the housing and having a latch bolt retractor supported in the case and operably connected to said latch bolt for retracting the latch bolt in response to rotation of either of the hubs, and a deadlocking mechanism including a deadlocking lever having a blocking surface and supported in the case to pivot between a deadlocking position wherein the blocking surface is disposed in blocking relation to the latch bolt in its projected position and an inactive position wherein the blocking surface is out of the path of movement of the latch bolt and having an auxiliary bolt for controlling movement of the deadlocking lever, the improvement comprising said deadlocking lever being formed from flat metal and having a profile of substantially uniform thickness, said profile including an inclined ramp portion formed on said deadlocking lever between its pivot and said blocking surface, and means for preventing transmission of force in a latch bolt retraction direction from said latch bolt to said ramp portion, said means for preventing transmission of force comprising opposing abutment surfaces on said case and said deadlocking lever.

2. The combination as set forth in claim 1 wherein said blocking surface comprises a forwardly facing surface on said deadlocking lever, and said opposing abutment surfaces comprise a forwardly facing abutment surface on said case and a rearwardly facing abutment surface on said deadlocking lever.

3. The combination as set forth in claim 2 wherein said case has a slot therein partially defined by said forwardly facing abutment surface and said deadlocking lever has a projection received in said slot and which defines said rearwardly facing abutment surface.

4. The combination as set forth in claim 2 wherein said case has a rear wall and said deadlocking lever has a tab at its rear end received in a slot in said rear wall and supporting said deadlocking lever for pivotal movement relative to said case.

5. The combination as set forth in claim 4 wherein said deadlocking lever has another tab at its rear end received in a slot in an associated side wall of said case and further supporting said deadlocking lever for pivotal movement relative to said case.

6. The combination as set forth in claim 1 wherein said ramp portion comprises a generally chevron shaped portion of said deadlocking lever.

7. The combination as set forth in claim 1 wherein said lock includes a stopworks having a stop member supported in said case for movement into and out of locking engagement with one of said hubs and said deadlocking mechanism includes a spring acting between said deadlocking lever and said stopworks and biasing said deadlocking lever toward its deadlocking position.

8. The combination as set forth in claim 1 wherein said latch bolt retractor mechanism includes means engageable with said ramp surface for moving said deadlocking lever toward its inactive position in response to initial movement of said latch bolt toward its retracted position.

9. The combination as set forth in claim 1 wherein said deadlocking lever is pivotally supported at one end and said blocking surface is defined by the other end of said deadlocking lever.

10. In a mortise lock having a case including a front and inner and outer side walls, a spring projected latch bolt movable through the front between projected and retracted positions, and a latch bolt retractor mechanism including inner and outer hubs journalled for independent coaxial rotation between the side walls and a retractor supported in the case for reciprocal rectilinear movement relative to said case between first and second positions respectively corresponding to projected and retracted positions of said latch bolt in response to rotation of either of the hubs, the improvement wherein said retractor comprises a generally L-shaped metallic member positioned adjacent one of said side walls and having one leg disposed generally rearward of said hubs and another leg extending forwardly from said one leg beyond said hubs and toward said front, and a non-metallic low friction retractor shoe attached to said L-shaped member adjacent said one leg and projecting from said one leg in the direction of the other of said side walls, said retractor shoe being disposed rearward of said hubs for engagement with said hubs, said mortise lock further including a first guide pin mounted in fixed cantilever position on said case rearwardly of said hubs and extending toward said hubs and in the direction of retractor movement, said first guide pin having a free end portion slidably received within a bore in said retractor shoe, and a second guide pin supported in fixed position on said case forward of said hubs and extending in a transverse direction relative to the direction of retractor movement, sad second guide pin slidably received within a slot formed in the forward end portion of said other leg.

11. The combination as set forth in claim 10 wherein said first guide pin has a non-circular cross section and said bore has a non-circular cross section substantially complementing the cross section of said first guide pin.

12. The combination as set forth in claim 10 wherein said retractor mechanism includes a hub lever pivotally supported in said case adjacent one of said side walls and engaged with said latch bolt, said hub lever having an integral tab extending transversely of the direction of retractor movement and engaged with a rearwardly facing surface on said retractor shoe for moving said latch bolt to a retracted position in response to movement of said retractor from its first to its second position.

13. In a mortise lock as set forth in claim 10 and having a deadlocking mechanism including a deadlocking lever having a blocking surface and supported in the case to pivot between a deadlocking position wherein the blocking surface is disposed in blocking relation to the latch bolt in its projected position and an inactive position wherein the blocking surface is out of the path of movement of the latch bolt and an auxiliary bolt for controlling movement of the deadlocking lever, the further improvement comprising said deadlocking lever being formed from flat metal and having a profile of substantially uniform thickness, said profile including an inclined ramp portion formed on said deadlocking lever between its pivot and said blocking surface, and means for preventing transmission of force in a latch bolt retraction direction from said latch bolt to said ramp portion.

14. In a mortise lock having a case including a front and inner and outer side walls, a spring projected latch bolt movable through the front between projected and retracted positions, a latch bolt retractor mechanism including inner and outer hubs journalled for independent rotation within the housing and having a latch bolt retractor supported in the case and operably connected to said latch bolt for retracting the latch bolt in response to rotation of either of the hubs, and a deadlocking mechanism including a deadlocking lever having a blocking surface and supported in the case to pivot between a deadlocking position wherein the blocking surface is disposed in blocking relation to the latch bolt in its projected position and an inactive position wherein the blocking surface is out of the path of movement of the latch bolt and including an auxiliary bolt for controlling movement of the deadlocking lever, the improvement comprising said deadlocking lever having a ramp portion intermediate its pivot and said blocking surface, and means for preventing transmission of force in a latch bolt retraction direction from said latch bolt to said ramp portion, said means including a slot in said case defining a forwardly facing abutment surface and a projection on said deadlocking lever received in said slot and defining a rearwardly facing abutment surface disposed in opposing relation to said forwardly facing abutment surface.

15. The combination as set forth in claim 14 wherein said deadlocking lever is pivotally supported at one end and said blocking surface is defined by the other end of said deadlocking lever.

* * * * *

UNITED STATES PATENT OFFICE

CERTIFICATE OF CORRECTION

Patent No. 4,118,056 Dated October 3, 1978

Inventor(s) Gordon A. Alexander

It is certified that error appears in the above-identified patent and that said Letters Patent are hereby corrected as shown below:

Column 1, line 53, "dedlocking" should be --deadlocking--.

Column 7, line 15, "borken" should be --broken--.

Column 7, line 47, "beng" should be --being--.

Column 9, line 26, "sad" should be --said--.

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*